US010352129B2

(12) United States Patent
Linklater

(10) Patent No.: US 10,352,129 B2
(45) Date of Patent: Jul. 16, 2019

(54) APPARATUS AND METHOD FOR CONTROLLING A DOWNHOLE TOOL

(71) Applicant: M-I Drilling Fluids UK Limited, Aberdeen (GB)

(72) Inventor: James Linklater, Westhill (GB)

(73) Assignee: M-I Drilling Fluids UK Limited, Aberdeen (GB)

( * ) Notice: Subject to any disclaimer, the term of this patent is extended or adjusted under 35 U.S.C. 154(b) by 268 days.

(21) Appl. No.: 15/308,143

(22) PCT Filed: Oct. 27, 2016

(86) PCT No.: PCT/US2016/058969

§ 371 (c)(1),
(2) Date: Nov. 1, 2016

(87) PCT Pub. No.: WO2017/075120

PCT Pub. Date: May 4, 2017

(65) Prior Publication Data

US 2017/0292346 A1 Oct. 12, 2017

(30) Foreign Application Priority Data

Oct. 27, 2015 (GB) ..... 1518928.5

(51) Int. Cl.
*E21B 34/10* (2006.01)
*E21B 41/00* (2006.01)
*E21B 34/06* (2006.01)

(52) U.S. Cl.
CPC ..... *E21B 34/066* (2013.01); *E21B 34/10* (2013.01); *E21B 41/00* (2013.01); *E21B 41/0085* (2013.01)

(58) Field of Classification Search
CPC ..... E21B 23/00; E21B 23/04; E21B 41/0085
See application file for complete search history.

(56) References Cited

U.S. PATENT DOCUMENTS 3,896,667 A * 7/1975 Jeter ..... E21B 23/04 175/40
2003/0178205 A1 9/2003 Henderson
(Continued)

OTHER PUBLICATIONS

International Preliminary Report on Patentability for the equivalent International patent application PCT/US2016/058969 dated May 11, 2018.

(Continued)

*Primary Examiner* — Robert E Fuller
(74) *Attorney, Agent, or Firm* — Jeffrey D. Frantz

(57) ABSTRACT

An apparatus for controlling a downhole tool comprises a generator for generating electricity; a rotor connected to the generator; an electronic circuit electrically connected to the generator; a sensor for sensing movement of the rotor, the sensor being electrically connected to the electronic circuit; and a valve for wellbore fluid and for activating or deactivating a tool or function of the downhole tool, the valve being controllable by being electrically connected to the electronic circuit. The generator is configured to generate electricity to at least the electronic circuit when a flow of wellbore fluid drives the rotor. A corresponding method of controlling a downhole tool comprises configuring the electric circuit to open or close the valve depending on a variation or pattern of a flow rate, controlling the downhole tool.

16 Claims, 4 Drawing Sheets

(56) References Cited

U.S. PATENT DOCUMENTS

| | | | |
|---|---|---|---|
| 2008/0047753 | A1 | 2/2008 | Hall et al. |
| 2014/0124195 | A1 | 5/2014 | Tahoun et al. |
| 2014/0218207 | A1 | 8/2014 | Gano et al. |
| 2014/0284104 | A1 | 9/2014 | Clausen et al. |
| 2015/0240580 | A1 | 8/2015 | Prill et al. |

OTHER PUBLICATIONS

Combined Search and Examination Report for the equivalent GB patent application 1518928.5 dated May 20, 2016.
International Search Report and Written Opinion for the equivalent International patent application PCT/US2016/058969 dated Feb. 7, 2017.

* cited by examiner

APPARATUS AND METHOD FOR CONTROLLING A DOWNHOLE TOOL

CROSS-REFERENCE TO RELATED APPLICATIONS

This application claims priority to GB non-Provisional Patent Application Serial No 1518928.5, filed on Oct. 27, 2015, which is incorporated herein by reference in its entirety.

BACKGROUND

A wellbore is formed using a drill bit that is urged downwardly at a lower end of a drill string. In the process of forming a wellbore, it is sometimes desirable to utilize various tripping devices to control a downhole tool. Tripping devices are typically dropped or released into the wellbore to operate a downhole tool. The tripping device usually lands in a seat of the downhole tool, thereby causing the downhole tool to operate in a predetermined manner. Examples of tripping devices, among others, include balls, plugs, and darts.

For example, a ball is dropped onto a seat located in the wellbore to close off the wellbore. Sealing off the wellbore allows pressure to be built up to actuate a downhole tool such as a packer, a liner hanger, or a running tool. The ball may be dropped to shear a pin to operate a downhole tool. There are drawbacks to using tripping devices such as a ball. Such drawbacks are the number of times they can be used, reliability, size of the tripping device, effecting down time, down time for a ball to reach its destination, and costs.

Other ways of operating a downhole remotely is to use a wire line, an electric cable from the surface to the downhole tool. This causes the problem of arranging and maintaining the wire line from the surface all the way down. A further way is to operate a downhole tool remotely by using a remotely controlled activating device. This has the significant drawback of needing an electric power source in the form of a battery. Batteries are not allowed in certain environments of a wellbore because of fire hazard. Downhole tools with batteries require strict limitations and regulations for transportations. Often a tool with a battery is simply not allowed or desired in the oil and gas industry.

SUMMARY

It is an object of the present disclosure to provide one or more apparatus and method by way of exemplary embodiments. Any embodiment may be combined with any other embodiment. These embodiments relate generally to an apparatus and method for controlling a downhole tool, and such a downhole tool. More particularly, the exemplary embodiments relate to an apparatus and method for remotely activating or deactivating a downhole tool. According to one embodiment, the apparatus may be a modular device which is intended to activate downhole tools by means of flow modulation or downlinking for communicating from the surface to the downhole tool. The modular apparatus may form one complete whole that can be arranged in any downhole tool for controlling the downhole tool.

It is an object of at least one embodiment of the present disclosure to provide an apparatus and method for controlling a downhole tool. A further object may be to provide a cost effective, reliable apparatus, and/or method for remotely controlling a variety of downhole tools and their respective functions.

According to one embodiment, an apparatus for controlling a downhole tool comprises a generator for generating electricity; a rotor connected to the generator; an electronic circuit electrically connected to the generator; a sensor for sensing movement of the rotor, the sensor being electrically connected to the electronic circuit; and a valve for wellbore fluid and for activating or deactivating a tool or function of the downhole tool, the valve being controllable by being electrically connected to the electronic circuit. The generator is configured to generate electricity to at least the electronic circuit when a flow of wellbore fluid drives the rotor.

According to one embodiment, the apparatus for controlling a downhole tool further comprises that the electronic circuit is configured to open or close the valve. According to a further embodiment, the apparatus is configured to sense, e.g. via the sensor, a flow rate, e.g. a flow rate variation, of the wellbore fluid driving the rotor; and wherein the electronic circuit is configured to open or close the valve according to the flow rate or flow rate variation.

According to one embodiment, the apparatus for controlling a downhole tool further comprises that the generator is arranged to generate electricity to the electronic circuit and the valve when a flow of wellbore fluid drives the rotor.

According to one embodiment, the apparatus forms one whole, complete, unit comprising the generator, rotor, electric circuit, sensor, and valve. This unit may be modular and configured for fitting, e.g. modular fitting, in downhole tools and controlling such different downhole tools.

According to one embodiment, the apparatus for controlling a downhole tool further comprises a body comprising the rotor, the electronic circuit, the valve, and the generator. The body comprising one or more legs extending radially to one or more, e.g. circumferential, support means, the one or more support means being arrangeable/supportable within the downhole tool. The body comprising a first fluid passage for wellbore fluid to the valve. One leg of the one or more legs comprising a second fluid passage for wellbore fluid from the valve to the tool or function of the downhole tool to be controlled. Opening the valve allows wellbore fluid to pass through the first fluid passage, the valve, and the second fluid passage.

According to one embodiment, the apparatus for controlling a downhole tool further comprises an absence of one or more batteries and/or an absence of wire line, or electric cable to or from surface. The apparatus can control a downhole tool without the need for a battery or wire line.

According to one embodiment, a downhole tool comprises such an apparatus.

According to one embodiment, a method of controlling a downhole tool is disclosed. The method comprising arranging such an apparatus in a downhole tool; configuring the electric circuit to open or close the valve depending on a variation or pattern of variation of a flow rate of the wellbore fluid within the downhole tool; varying the flow rate of the wellbore fluid passing through the apparatus to control the downhole tool so as to open or close the valve and thereby activating or deactivating the downhole tool.

According to one embodiment, the method of controlling a downhole tool further comprises an absence of one or more of the following group: one or more batteries, or an electric cable from the surface, for supplying power to the apparatus. The controlling of the downhole tool only can be made when the flow rate drive the rotor to allow the generator to generate electricity for the electronic circuit and the valve.

At least one embodiment disclosed provides an apparatus and method for controlling a downhole tool. At least one embodiment does so technically simple and reliable. At least one embodiment is costs effective and avoids cumbersome arrangements. At least one embodiment allows controlling remotely the downhole time repeatedly, as well as controlling different downhole tools and their different functions. At least one embodiment controls a downhole tool while it is operating in it's working condition and environment.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed or described embodiment may be technically combined with any other claimed or described embodiment(s).

BRIEF DESCRIPTION OF THE DRAWINGS

The accompanying drawings illustrate presently exemplary embodiments of the disclosure, and together with the general description given above and the detailed description of the embodiments given below, serve to explain, by way of example, the principles of the disclosure.

DETAILED DESCRIPTION

Figure 1:
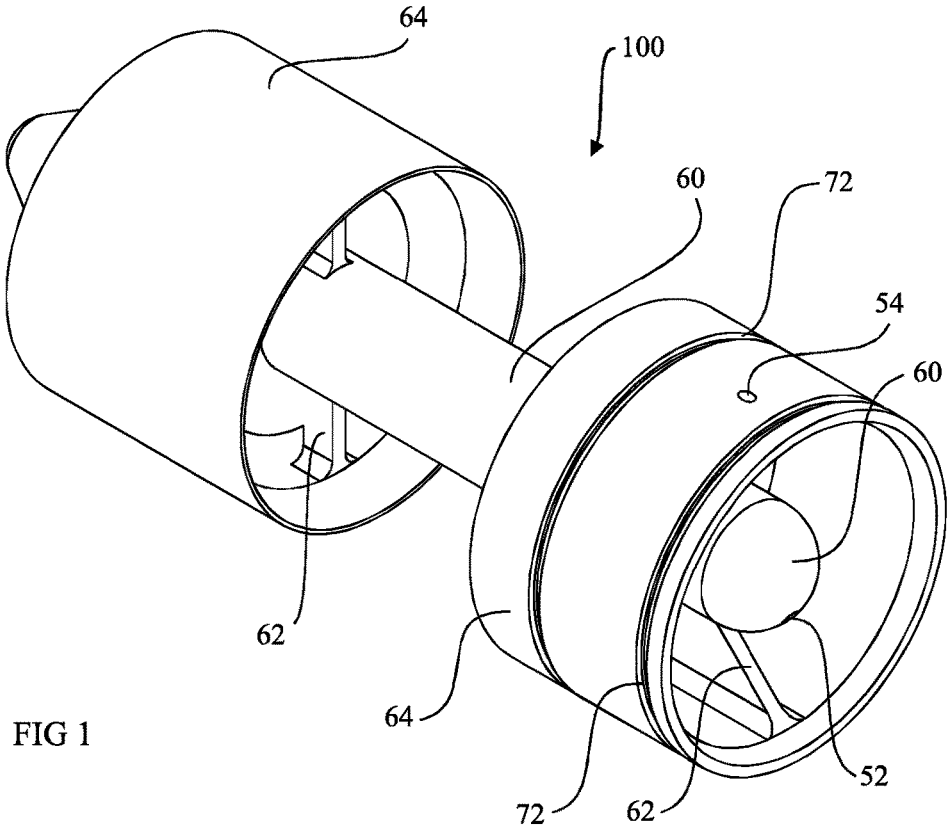
FIG. 1 is a diagrammatic illustration of an apparatus according to an exemplary embodiment of the present disclosure.
Figure 2:
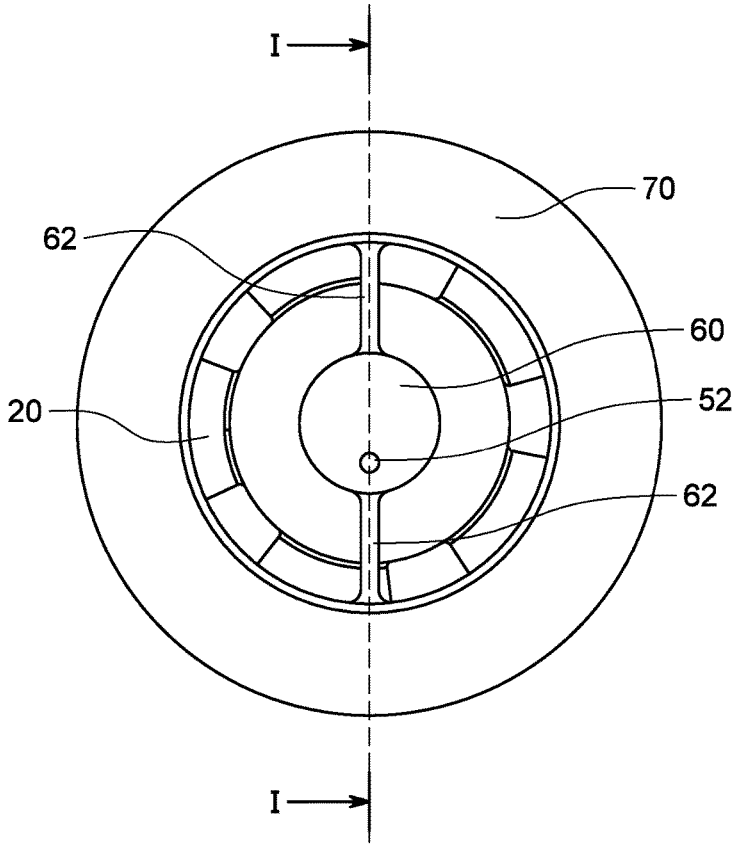
FIG. 2 is a diagrammatic illustration of an end view of an apparatus according to an exemplary embodiment of the present disclosure.

According to an exemplary embodiment, an apparatus for controlling a downhole tool, comprises a generator 10 for generating electricity; a rotor 20 connected to the generator 10; an electronic circuit 30 electrically connected to the generator 10; a sensor 40 for sensing movement of the rotor 20, the sensor 40 being electrically connected to the electronic circuit 30; and a valve 50 for wellbore fluid and for activating or deactivating a tool or function of the downhole tool, the valve 50 being controllable by being electrically connected to the electronic circuit 30. The generator 10 is configured to generate electricity to at least the electronic circuit 30 when a flow of wellbore fluid drives the rotor 20. This is illustrated in FIGS. 1-3.

Figure 3:
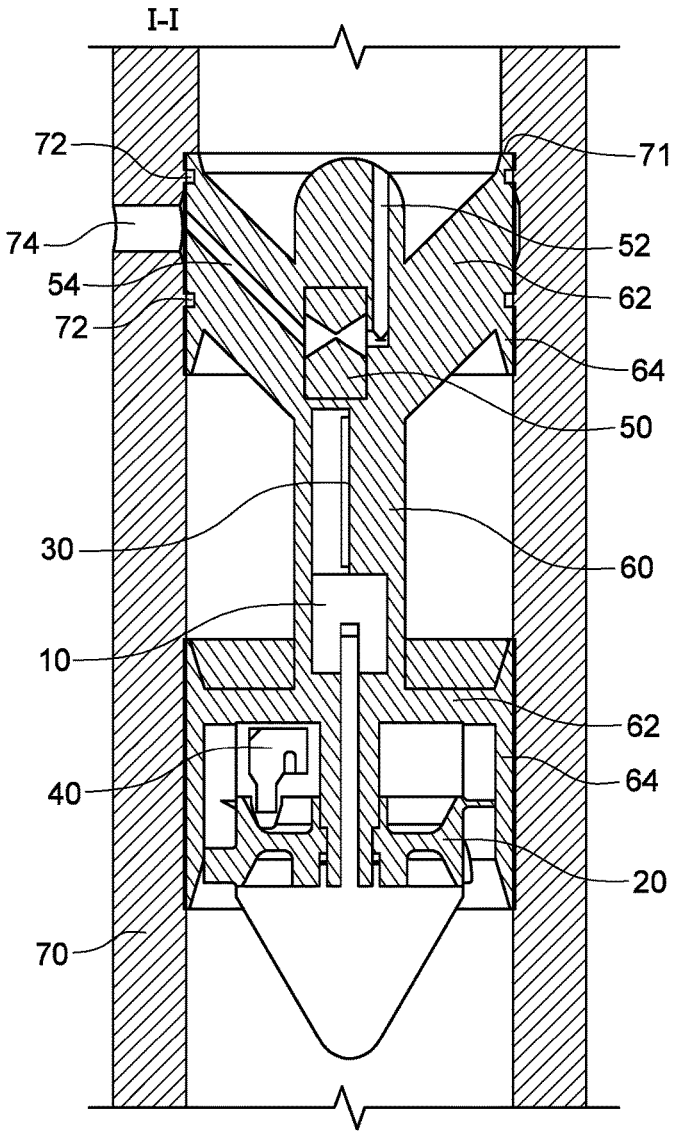
FIG. 3 shows a cross section A-A as indicated in FIG. 2 of an apparatus according to an exemplary embodiment of the present disclosure.
Figure 4:
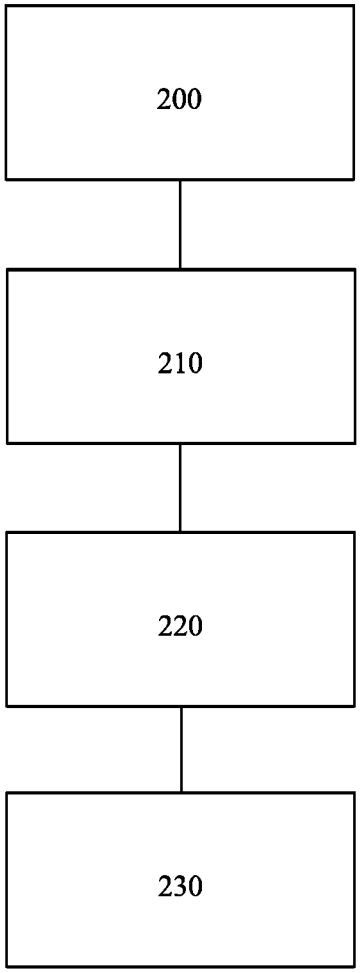
FIG. 4 shows a flow chart of a method according to an exemplary embodiment of the present disclosure.

According to an exemplary embodiment, as best illustrated by FIG. 3, the apparatus for controlling a downhole tool comprises the generator 10. The generator 10 is for generating electricity to the apparatus, especially to the circuit board 30 and to the valve 50 if the valve needs electrical power to open or close. The apparatus for controlling a downhole tool, comprises also the rotor 20. The rotor 20 is connected to the generator 10. The apparatus is preferably arranged within a downhole tool such that a flow of wellbore fluid is able to move the rotor 20. The rotor 20 may be for transmitting motion, as in blower or turbine. The rotor 20 may be an impeller 20. A flow of wellbore fluid may rotate the rotor 20 and this rotational energy is converted by the generator 10 in to electric energy, so that electricity is produced. Electricity is thus only produced when a flow of fluid rotates the rotor 20.

According to an embodiment, the electronic circuit 30 is electrically connected to the generator 10. The generator 10 is wired to the electronic circuit 30 so that electricity generated by the generator may be fed to the electronic circuit 30. The electronic circuit may then in turn feed other parts of the apparatus or even a downhole tool. The electronic circuit may be electronics for other parts of the apparatus, such as for the valve 50, sensor 40, or other part. The electricity generated may be for electronics for the other parts of the apparatus, such as for the valve 50, sensor 40, tool electronics, or other part. The electronic circuit 30 may be a circuit board, e.g. an embedded circuit board. The electronic circuit 30 may comprise a programmable memory comprising computer logic configured to perform all the steps of the method disclosed herein, when said program is run or executed on a computer or processing means on the electronic circuit 30.

According to one embodiment, the sensor 40 is a sensor for sensing movement of the rotor 20. The sensor 40 is electrically connected, wired, to the electronic circuit 30. The sensor 40 may be positioned within the apparatus so that it senses when a part of the rotor 20 passes by the sensor 40. The sensor 40 may be a part of the generator 10 that can sense the rotational speed of the generator. The sensor 40 together with the electronic circuit 30 may give a rotation rate of the rotor, for example the rotations per minute, rpm. Since the size of the apparatus is known as well as the size of the opening of the downhole tool, the flow rate of wellbore fluid may be measured by use of the sensor 40.

According to one embodiment, the valve 50 is opening or closing to control flow of wellbore fluid. Pressurized wellbore fluid is normally present within the downhole tool so opening the valve 50 would allow wellbore fluid to pass through the valve 50, and closing the valve 50 would prevent wellbore fluid to pass through the valve 50. Opening or closing the valve 50 activates or deactivates a tool or function of the downhole tool. Well bore fluid may enter a first fluid passage 52 passing wellbore fluid to the valve 50. When the valve 50 is open, wellbore fluid may lead the wellbore fluid through a second fluid passage 54 to control a downhole tool. The valve 50 may be controllable by being electrically connected to the electronic circuit 30. The valve 50 may be, for example, a solenoid valve.

According to one embodiment, the generator 10 is configured to generate electricity to at least the electronic circuit 30 when a flow of wellbore fluid drives the rotor 20. Electric power to control the downhole tool is thus only generated when a flow of wellbore fluid drives the rotor 20. In this way no battery or wire to the surface is necessary for controlling the downhole tool.

According to one embodiment, the electronic circuit 30 is configured to open or close the valve 50. According to one embodiment, the apparatus is configured to sense the flow rate driving the rotor 20, by the sensor 40 sensing the rotational movement of the rotor 20. The sensed flow rate may be a flow rate variation of the wellbore fluid. The electronic circuit 30 may be configured to open or close the valve 50 according to the flow rate and/or the flow rate variation.

A flow rate variation may be, for example, 1000 rpm sensed by the sensor 40 for a certain time period, then subsequently 800 rpm for a certain time period, then subsequently 1000 rpm for a certain time period, and then subsequently 800 rpm for a certain time period. Such a flow rate variation pattern may be created from the surface. The sensor 40, sensing the rotation of the rotor 20, together with the electronic circuit 30 looks for such a flow rate variation pattern. When the electronic circuit 30 has detected and recognised the pattern, then the electronic circuit 30 may control the valve 50 to open or close, which controls the downhole tool or a specific function of the downhole tool.

According to one embodiment, the generator 10 is arranged to generate electricity to the electronic circuit 30 and the valve 50 when a flow of wellbore fluid drives the rotor 20. The generator 10 may additionally generate electric energy to other parts of the apparatus and/or the downhole tool.

According to one embodiment, the apparatus forms one whole unit 100 comprising the generator 10, the rotor 20, the electric circuit 30, the sensor 40, and the valve 50. Such a unit 100 may be modular and configured for, as a module, fitting in different downhole tools and controlling such different downhole tools. The apparatus forms one whole complete unit comprising the generator, rotor, electric circuit, sensor, and valve and such a unit that can control downhole tools when sensing a flow rate or a flow rate variation. Therefore, the apparatus can be used as a module that can be used for different kinds of downhole tools. The unit 100 may be a stand alone modular unit. The unit 100 forms one complete whole that does not need any battery or electric wires to control a downhole tool. The apparatus is a unit that minimizes costs and complexity and can easily be used for controlling a downhole tool. According to one embodiment and as illustrated in FIG. 3, the unit 100 may be installed within a downhole tool by arranging the unit against a shoulder 71. This allows for cost effective, simple, and reliable installation of the unit within a downhole tool.

According to one embodiment, the apparatus further comprises a body 60 comprising at least the generator 10, the rotor 20, the electronic circuit 30, and the valve 50. The body 60 may be a central body and/or the body 60 may be arranged in the flow of wellbore fluid. The body 60 may additionally comprise the sensor 40. The body 60 may comprise one or more legs 62 extending radially to one or more support means 64. The one or more legs 62 may extend radially from the central body 60 to the one or more support means 64 being circumferential in relation to the central body 60. The one or more support means 64 being arrangeable within the downhole tool. For example, the downhole tool 70 may comprise a stop or shoulder 71 that can support an end of the one or more support means 64. According to one embodiment, the circumferential support means 64 comprise the shoulder 71. The circumferential support means 64 and the shoulder 71 may form, may form/shape the outside of, the modular unit 100. In this way the unit 100 can be technically easy to install and fit in different downhole tools. This may allow the one and the same unit 100 to be used for a family of downhole tools. This may allow the one and the same unit 100 to replace a different controlling device, e.g. a ball drop device, in a downhole tool.

According to one embodiment, the body 60 may comprise a first fluid passage 52 for wellbore fluid to the valve 50. One leg, or a plurality of legs, of the one or more legs 62 may comprise a second fluid passage 54 for wellbore fluid from the valve 50 to the tool or function of the downhole tool to be controlled. Opening the valve 50 allows therefore, when wellbore fluid is present, wellbore fluid to pass through the first fluid passage 52, the valve 50, and the second fluid passage 54.

According to one embodiment, the apparatus is a unit 100 comprising the generator 10, the rotor 20, the electric circuit 30, the sensor 40, the valve 50, the body 60, the one or more legs 62, and the one or more support means 64. Such a complete unit 100 for controlling a downhole tool may be modular so that it can be used in different types of downhole tools.

According to one embodiment, the one or more support means 64 are circumferential and the body 60 is centrally arranged within the one or more circumferential support means 64. The one or more circumferential support means 64 may be formed as a cylinder with the body 60 in the center of the cylinder and wellbore fluid can flow trough. When the apparatus is installed in a downhole tool, wellbore fluid is flowable trough the one or more circumferential support means 64 and around the body 60. The rotor 20 may be arranged in the space between the one or more circumferential support means 64 and the central body 60. The one or more legs 62 connect the body 60 to the one or more circumferential support means 64.

According to one embodiment, the one or more legs 62 extending radially to one or more support means are two legs 62 extending radially to each support means. The two legs 62 may be arranged with an angle of 180 degrees between the two legs. For example, from the central body 60 two legs extend radially to one circumferential support means 64. Using only two legs 62 for connecting the body 60 and the support means 64 creates a stable unit and at the same time allows a good flow of wellbore fluid through the unit 100. According to one embodiment, the one or more legs 62 extending radially to one or more support means are three legs 62 extending radially to each support means. The three legs 62 may be arranged with an angle of 120 degrees between the three legs.

According to one embodiment, the apparatus may be arranged in the downhole tool in an opening where wellbore fluid flows. The one or more circumferential support means 64 may comprise sealing means 72, for example o-rings, for sealing against an inner wall of a wellbore fluid passage of the downhole tool. In this way the wellbore fluid passing through the first fluid passage 52, the valve 50, and the second fluid passage 54 to the tool or function of the downhole tool to be controlled is sealed. Thus, as illustrated in FIG. 3, fluid passing through the second fluid passage 54 to a passage 74 leading to the tool or function of the downhole tool to be controlled is sealed off from flowing back to the wellbore fluid passage of the downhole tool.

According to one embodiment, the apparatus comprises an absence of one or more batteries. According to one embodiment, the apparatus comprises an absence of a wire line, or an electric cable to or from the surface. In other words, the apparatus requires no batteries or wire line, or electric cable, to or from the surface. The apparatus, or unit 100, or downhole tool, includes no battery or wire line. This is a technical advantage because the danger involved with using batteries. Downhole tools are normally not allowed to be shipped with batteries, or only under strict precautions, and there are strict regulations that must be followed with regard to batteries. It is a significant advantage not to need, exclude, a battery when controlling a downhole tool. Not having to pull an electric wire from the surface along the whole drill string down to the downhole tool is also an advantage. The apparatus is able to supply the energy for controlling of the downhole tool by using the flow of wellbore fluid. According to one embodiment, the apparatus comprises an absence of radio controlled equipment. Thus, the apparatus does not require the use of radio transmitter and receiver for controlling the downhole tool.

According to one embodiment, the valve 50 may comprise a solenoid valve. The valve 50 may be a solenoid valve 50 that can use the electricity generated by the generator 10.

The electricity may be wired through the electronic circuit 30 and fed to the solenoid valve 50. The apparatus uses the flow of wellbore fluid to generate the electricity to control the downhole tool. The apparatus also interprets the flow of wellbore fluid to control, activate or deactivate, the downhole tool. According to one embodiment, the valve 50, or solenoid valve, is a pilot valve.

According to one embodiment, a downhole tool comprises an apparatus according to any one of the preceding embodiments. A downhole tool can be equipped with the apparatus described herein. Even a downhole tool with a ball drop can have the ball drop mechanism removed and replaced with the apparatus. This is technically possible because the apparatus is a unit. This unit can be handled like a module that can be arranged in a downhole tool for controlling the downhole tool. A downhole tool comprising the apparatus has the technical advantage of being able to be controllable by the apparatus.

According to one embodiment, a method is disclosed as illustrated in FIG. 5. Even if the method has been illustrated with steps in sequence, the method steps must not be taken in order as illustrated. The method is for controlling a downhole tool. The method comprises the following steps and the first two steps may be taken in any order:

arranging an apparatus as described herein in a downhole tool (illustrated as 200 in FIG. 5);

configure the electric circuit 30 to open or close the valve 50 depending on a variation or pattern of variation of a flow rate of the wellbore fluid within the downhole tool (illustrated as 210 in FIG. 5); and vary the flow rate of the wellbore fluid passing through the apparatus to control the downhole tool so as to open or close the valve 50 and thereby activating or deactivating the downhole tool (illustrated as 220 in FIG. 5).

The pump rate variation, controlled at the surface, varies the flow rate of the wellbore fluid passing through the apparatus driving the rotor, thereby controlling the downhole tool so as to open or close the valve, and thereby activating or deactivating the downhole tool. This downlinking controls the downhole tool without the need for a battery or wireline.

According to one embodiment, the method further comprises an absence of one or more of the following group: one or more batteries, or an electric cable from the surface, for supplying power to the apparatus. The controlling of the downhole tool can only can be made when the flow rate drives the rotor to allow the generator to generate electricity for the electronic circuit and the valve. Hereby the method of controlling a downhole tool, using the apparatus, controls the downhole tool without the need for a battery or wireline. According to one embodiment, the electronic circuit may comprise a computer program product, e.g. a memory, comprising computer logic configured to perform all the steps of the method, when said program is run or executed on the electronic circuit.

According to one embodiment, a downhole tool with a drop ball arrangement for controlling the downhole tool may use the apparatus for controlling the downhole tool. The apparatus may replace the ball drop arrangement in the downhole tool. Hereby the downhole tool can be controlled without having to use drop balls.

It will be apparent to those skilled in the art that various modifications and variations can be made to the apparatus and method. Other embodiments will be apparent to those skilled in the art from consideration of the specification and practice of the disclosed apparatus and method. It is intended that the specification and examples be considered as exemplary only, with a true scope being indicated by the following claims and their equivalents.

The invention claimed is:

1. An apparatus for controlling a downhole tool, comprising:

a generator for generating electricity;

a rotor connected to the generator;

an electronic circuit electrically connected to the generator;

a sensor for sensing rotational movement of the rotor, the sensor being electrically connected to the electronic circuit; and a valve for wellbore fluid and for activating or deactivating a tool or function of the downhole tool, the valve being controllable by being electrically connected to the electronic circuit;

wherein the generator is configured to generate electricity to at least the electronic circuit when a flow of wellbore fluid drives the rotor;

wherein the apparatus is configured to sense a flow rate of the wellbore fluid driving the rotor by the sensor sensing the rotational movement of the rotor; and wherein the electronic circuit is configured to open or close the valve according to the sensed flow rate.

2. The apparatus of claim 1, wherein the apparatus comprises an absence of one or more batteries.

3. The apparatus of claim 1, wherein the apparatus forms one whole unit comprising the generator, rotor, electric circuit, sensor, and valve.

4. The apparatus of claim 3, wherein the unit is modular and configured for fitting in and controlling different downhole tools.

5. The apparatus of claim 1, wherein the generator is arranged to generate electricity to the electronic circuit and the valve when a flow of wellbore fluid drives the rotor.

6. The apparatus of claim 1, further comprising a body comprising the rotor, the electronic circuit, the valve, and the generator; the body comprising one or more legs extending radially to one or more support means, the one or more support means being arrangeable within the downhole tool; the body comprising a first fluid passage for wellbore fluid to the valve; and one leg of the one or more legs comprising a second fluid passage for wellbore fluid from the valve to the tool or function of the downhole tool to be controlled; wherein opening the valve allows wellbore fluid to pass through the first fluid passage, the valve, and the second fluid passage.

7. The apparatus of claim 6, wherein the one or more support means are circumferential and the body is centrally arranged within the circumferential support means; and wherein, when the apparatus is installed in a downhole tool, wellbore fluid is flowable through the circumferential support means and around the body.

8. The apparatus of claim 7, wherein the circumferential support means comprises sealing means for sealing between the circumferential support means and a downhole tool.

9. The apparatus of claim 6, wherein the one or more legs extending radially to one or more support means are two legs extending radially to each support means.

10. The apparatus of claim 6, wherein the one or more legs extending radially to one or more support means are three legs extending radially to each support means.

11. The apparatus of claim 1, wherein the apparatus comprises an absence of wire line, or electric cable to or from surface.

12. The apparatus of claim 1, wherein the valve comprises a solenoid valve.

13. A downhole tool comprising an apparatus according to claim 1.

14. A method of controlling a downhole tool, the method comprising:

arranging the apparatus according to claim 1 in a downhole tool;

configuring the electric circuit to open or close the valve depending on a variation or pattern of variation of a flow rate of the wellbore fluid within the downhole tool; and varying the flow rate of the wellbore fluid passing through the apparatus to control the downhole tool so as to open or close the valve and thereby activating or deactivating the downhole tool.

15. The method of claim 14, further comprising not using one or more of the following group: one or more batteries, and an electric cable from the surface, for supplying power to the apparatus.

16. The method of claim 14, wherein the controlling of the downhole tool only can be made when the flow rate drives the rotor to allow the generator to generate electricity for the electronic circuit and the valve.

* * * * *